US005810654A

United States Patent [19]

Suzuki et al.

[11] Patent Number: 5,810,654

[45] Date of Patent: Sep. 22, 1998

[54] COIN SUPPLY AND COLLECTION APPARATUS FOR GAMING MACHINES

[75] Inventors: Yasuo Suzuki; Reiji Sugihara, both of Tokyo, Japan

[73] Assignee: Universal Sales Co., Ltd., Tokyo, Japan

[21] Appl. No.: 666,686

[22] Filed: Jun. 17, 1996

[30] Foreign Application Priority Data

Jun. 22, 1995 [JP] Japan ..... 7-156036

[51] Int. Cl.[6] ..... G07D 1/00

[52] U.S. Cl. ..... 453/17; 198/587; 453/56

[58] Field of Search ..... 453/18, 56, 63, 453/17; 194/344, 350; 193/DIG. 1; 198/372.1, 587, 560

[56] References Cited

U.S. PATENT DOCUMENTS

| | | | |
|---|---|---|---|
| 3,682,288 | 8/1972 | Montacie | 198/587 X |
| 4,342,384 | 8/1982 | Fukase et al. . | |
| 5,100,367 | 3/1992 | Abe | 453/49 |
| 5,222,583 | 6/1993 | Bergmann et al. | 453/56 X |
| 5,292,279 | 3/1994 | Takemoto et al. | 453/56 |
| 5,554,070 | 9/1996 | Takatoshi et al. | 453/63 X |

FOREIGN PATENT DOCUMENTS

| | | | |
|---|---|---|---|
| U-9303448 | 8/1993 | Germany . | |
| 21286 | 1/1991 | Japan | 453/56 |
| 12539 | 1/1993 | Japan | 453/18 |
| 40869 | 2/1993 | Japan | 453/18 |
| 324975 | 12/1993 | Japan | 453/18 |
| 187541 | 7/1994 | Japan | 453/56 |
| 218134 | 8/1994 | Japan | 453/56 |
| 2200489 | 3/1988 | United Kingdom . | |

*Primary Examiner*—F. J. Bartuska
*Attorney, Agent, or Firm*—Rohm & Monsanto, PLC

[57] ABSTRACT

A coin supply and collection apparatus that is applied easily to an existing carousel of the type having a plurality of gaming machines, is readily installed without requiring significant alteration of the gaming machine bases or the internal components of the gaming machines. The apparatus is provided with a first belt conveyor for receiving coins from a coin-providing side and conveys them, as coins to be used in each of the gaming machines, beneath the plurality of gaming machines. A second belt conveyer receives the coins fed from the first belt conveyer and conveys them to coin carriers associated with each of the gaming machines.

11 Claims, 17 Drawing Sheets

COIN SUPPLY AND COLLECTION APPARATUS FOR GAMING MACHINES

BACKGROUND OF THE INVENTION

1. Field of the Invention

This invention relates to a coin supply and collection apparatus employed for gaming machines such as slot machines, video poker game machines, and the like, which use coins and/or game media, such as medals, tokens, and the like.

2. Prior Art

Referring to the coin supply and collection apparatus employed for gaming machines, e.g. as mentioned in Japanese Utility Model Laid-Open No. 55-166288 (U.S. Pat. No. 4,342,384), there is known an apparatus employing a coin conveyor and a coin feeder for supplying and collecting the coins automatically toward each of a plurality of gaming machines in a group.

This coin supply and collection apparatus includes the coin conveyor which consists of a belt conveyor for conveying the coins toward the plurality of gaming machines, coin storage tanks provided within each of the gaming machines, and coin supply tanks provided for every gaming machine below the conveyor. Also, there are provided escalator hoppers for lifting and conveying the coins from the coin supply tanks to the coin storage tanks within the gaming machines above the conveyor. In coin conveyance routes via the escalator hoppers, first path switches are disposed just above the coin storage tanks installed within the gaming machines, and second path switches are disposed just above the coin conveyor, respectively. The first path switches feed the coins which have been conveyed via the escalator hoppers to the coin storage tanks within the gaming machines, and the second path switches change feeding of the coins toward the coin conveyor on the way of the conveyance routes of the escalator hoppers, for conveying the coins to the coin supply and collection apparatus provided at an end of the coin conveyor. Further, sensors for detecting increase and decrease in the quantity of the coins are provided in the coin supply tanks, and cutoff and release of the two path switches are executed in response to signals from the sensors.

According to the above structure, a coin circulation for every gaming machine and a coin circulation in a group of the gaming machines are executed in an interlocked manner.

However, since the above mentioned coin supply and collection apparatus is arranged as to perform supply and collection of the coins employing the coin conveyor which consists of one belt conveyor for a plurality of gaming machines, the apparatus may be used only where the plurality of gaming machines are arranged straight in a row. Further, when an arrangement of the plurality of gaming machines which had been once arranged is modified, it requires significant cost and time because the length and form of the coin conveyor must be accordingly modified. In addition, since the apparatus employs two path switches as mentioned above, control of the apparatus becomes complex and also there are a large number of parts, there is a problem that the cost of the entire apparatus is high.

In casinos in the U.S. and in other countries, a location for a plurality of gaming machines (e.g., slot machines or video poker game machines) installed in a group is referred to as a "carousel." Since forms of the carousels are not only linear arrangements but also arrangements containing curves or circles as a whole or partially, it is difficult to apply the carousel to the above coin supply and collection apparatus.

Further, in a casino, since devices such as hoppers and the like are usually housed within the gaming machines, when the above-mentioned prior art is applied to the existing carousel of the type having the plurality of gaming machines, it is necessary to reconstruct the interiors of the gaming machines at great expense. In addition, it becomes necessary to modify the bases beneath the gaming machines and the carousel.

SUMMARY OF THE INVENTION

It is, therefore, an object of the present invention to provide a coin supply and collection apparatus that is applied easily to an existing carousel of the type having a plurality of gaming machines, without requiring significant alteration of gaming machine bases, a carousel, and interiors of the gaming machines.

According to the present invention, a coin supply and collection apparatus for a plurality of gaming machines includes:

a conveyor arrangement for conveying coins used in each of the gaming machines, being disposed beneath the plurality of gaming machines; and a coin feeder for feeding the coins fed from the conveyor arrangement into each of the plurality of gaming machines;

wherein the conveyor arrangement, toward the coin feeder corresponding to one of the gaming machines, consists of a first conveyor for receiving the coins from a coin-providing side and conveying them, and a second conveyor for receiving the coins fed from the first conveyor and conveying them toward a side of the coin feeder.

According to the present invention, among two conveyors provided for the coin feeder corresponding to one of the plurality of gaming machines, the first conveyor receives the coins from the coin providing side (e.g., a conveyor corresponding to the former gaming machine) and conveys them to the second conveyor. Then, the second conveyor provides the coins fed from the first conveyor into the inside of a corresponding gaming machine via the coin feeder. In this way, the coins are provided from the first conveyor disposed corresponding to each of the gaming machines to the second conveyor, and then, from the second conveyor through the coin feeder to each of the gaming machines.

Further, by feeding the coins from the second conveyor to the first conveyor corresponding to a succeeding gaming machine, the coins are conveyed and collected in order according to the arrangement of the plurality of gaming machines. That is, if the conveyors corresponding to each of the gaming machines are arranged in a straight line or in a broken line along a direction of the arrangement of the plurality of gaming machines, the coins are conveyed and collected as mentioned above.

In this way, since every gaming machine is provided with a pair of two conveyors, it is possible to arrange the gaming machines not only in a straight line but also with a predetermined angle. Accordingly, when the plurality of gaming machines are arranged in a broken line as well as when they are arranged in a straight line, it is possible to construct freely paths of conveying and collecting of the coins for each of the gaming machines.

Therefore, this invention is not limited to a specific arrangement of the gaming machines, and it may be employed widely to chance halls which have the above-mentioned carousel or a plurality of gaming machines, whereby automation of supply and collection of the coins is promoted.

In an embodiment of the invention, the gaming machine is installed on a gaming machine base, the first and second conveyors consist of a pair of belt conveyors disposed within the gaming machine base, and the coin feeder consists of a coin carrier of escalator type disposed within the same gaming machine base.

In one embodiment of the invention, the first and second conveyors consist of a pair of belt conveyors disposed within the gaming machine base upon which the gaming machine is installed, and the coin feeder consists of the coin carrier of the escalator type disposed within the gaming machine base. Accordingly, the coins are fed into a succeeding gaming machine via the belt conveyor disposed beneath the succeeding gaming machine, and, the coins are fed into the present gaming machine via the coin carrier of the escalator type.

In another embodiment of the invention, a positioning member is provided at a location below the conveyor so as to be rotatable therewith, and a support is engaged with the positioning member and supports the conveyor to be movable in the direction of a plane to be adjusted.

In a still further embodiment of the invention, the positioning member is provided at a location below the conveyor so as to be rotatable therewith, and there is further provided a pedestal arranged to engage with the positioning member and to be movable in the direction of a plane to be adjusted. Therefore, the arrangement of the plurality of gaming machines may be changed easily with the positioning members and the pedestals.

In the above-mentioned embodiment of the invention, the belt conveyors are connected either linearly or with a predetermined angle along the direction of conveying the coins.

In the above embodiment of the invention, since the belt conveyors are connected linearly or with a predetermined angle along the direction of conveying the coins, a system for coin supply and collection can be easily applied to the existing carousel when the plurality of gaming machines are installed.

In yet another embodiment of the invention, the first conveyor and the second conveyor are provided with a connector for connecting with each other, respectively, and are arranged to be rotatable with the connector in the center. In this embodiment, it is desirable that the connector consists of an upper joint member and a lower joint member. The upper joint member is provided at a lower side of an end of the first conveyor in a manner rotatable in a predetermined range, having an inlet to an inside thereof and an outlet from the inside such that the coins pass through. The lower joint member is provided at an upper side of an end of the second conveyor, fitting with the upper joint member installed in the first conveyor in a manner rotatable with a fitting portion in the center, and having an inlet to an inside thereof and an outlet from the inside such that the coins pass through.

In the further embodiment of the invention, at an end of the first conveyor and an end of the second conveyor, the connector for connecting both of the conveyors is provided. As to the connector, even if the arrangement of the gaming machines is modified, a position of delivery between the first conveyor and the second conveyor is not changed.

In this embodiment of the invention, the upper joint member and the lower joint member are rotatable with the fitting portion in the center, and the coins move through the upper and lower joint members. Therefore, the coins are transferred with certainty from the first conveyor to the second conveyor.

The foregoing and other objects, features, and advantages of the invention will become more apparent from the following detailed description taken in conjunction with the accompanying drawings.

DETAILED DESCRIPTION

Figure 1:
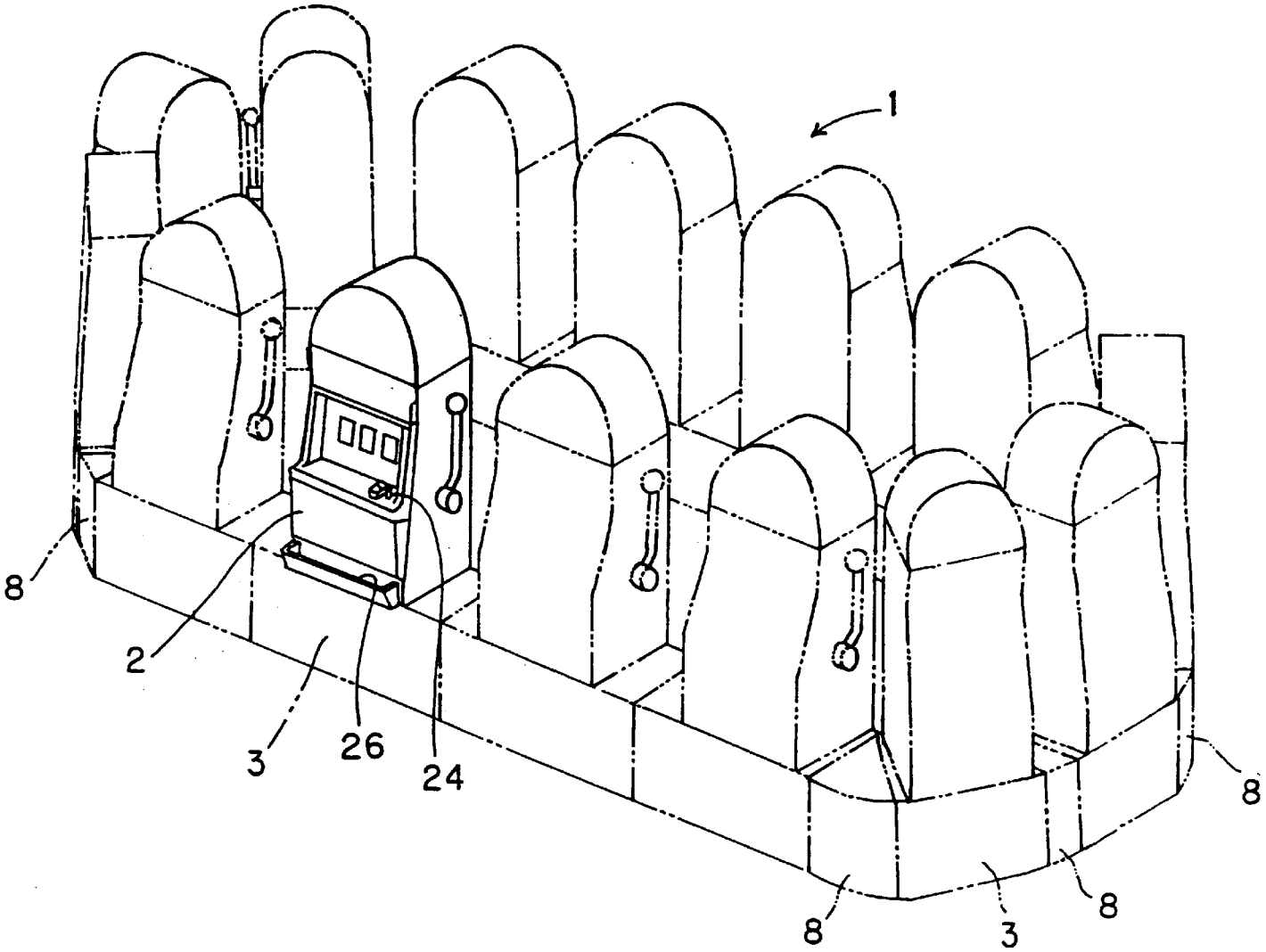
FIG. 1 is a perspective view of a specific illustrative arrangement of a plurality of gaming machines in a group.
Figure 2:
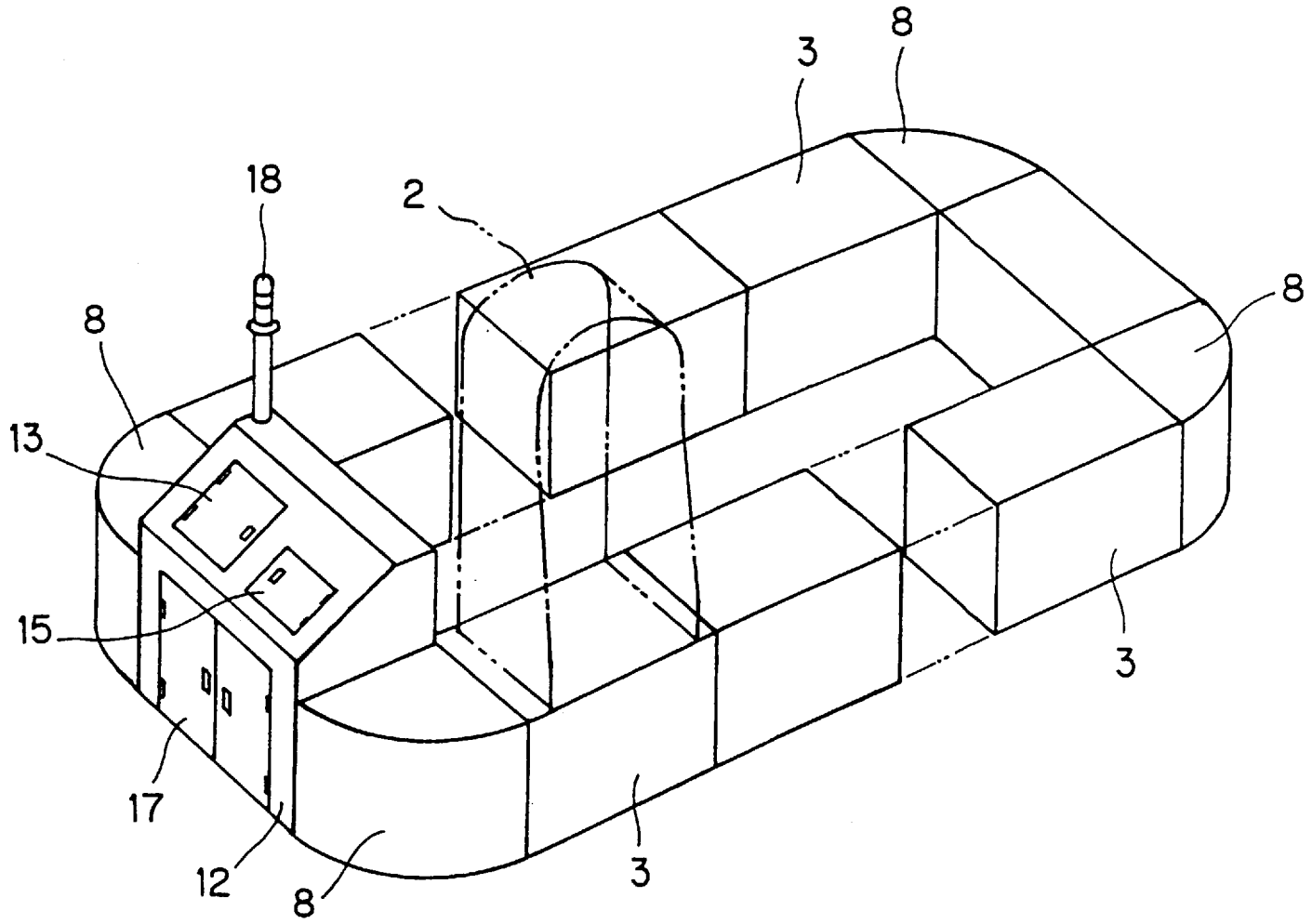
FIG. 2 is a simplified perspective representation of an entire coin supply and collection system, for the plurality of gaming machines shown in FIG. 1.

FIG. 1 shows a specific illustrative embodiment of the invention in the form of an arrangement of a plurality of gaming machines in a group in a carousel 1. FIG. 2 shows an external view of a coin supply and collection system for the plurality of gaming machines.

Figure 3:
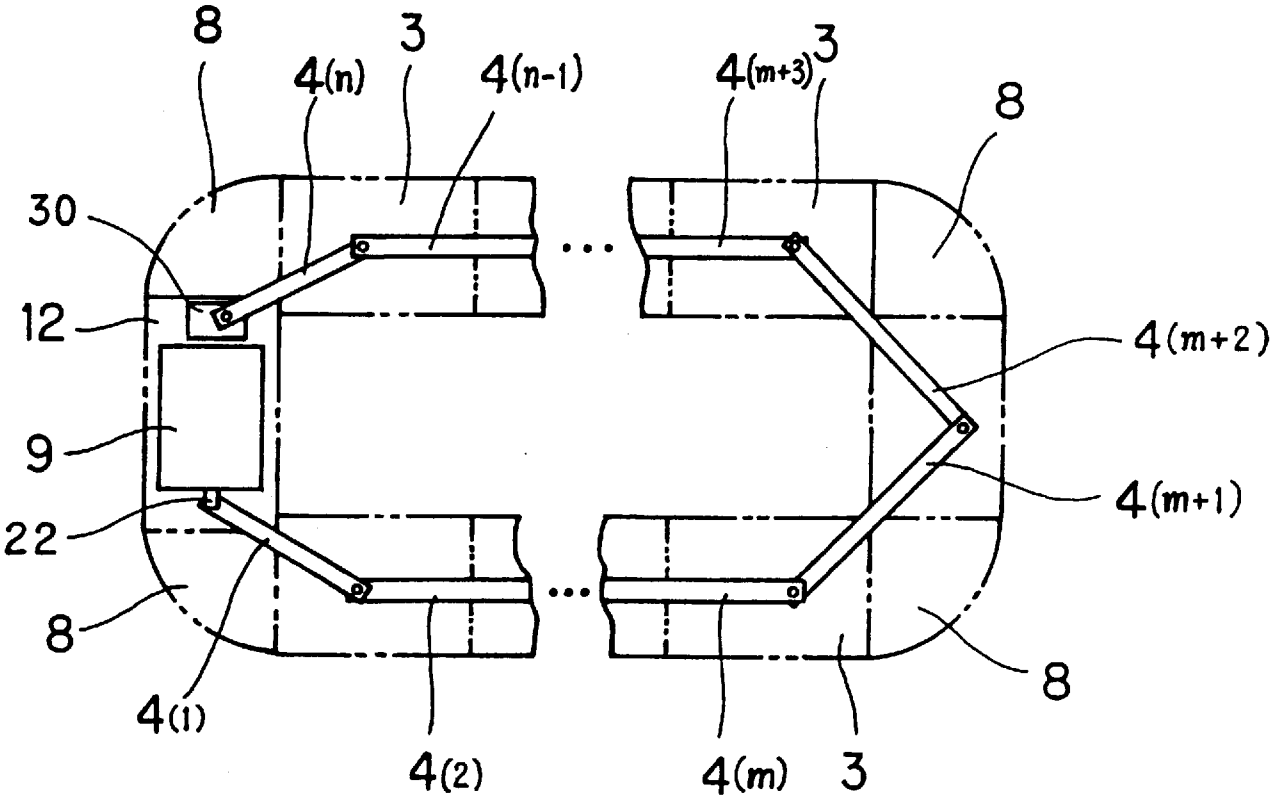
FIG. 3 is a view taken from above of the arrangement of belt conveyors in the coin supply and collection system of FIG. 2.

The plurality of gaming machines 2 which are employed in carousel 1 as shown in FIG. 1 are divided into those arranged in a straight line and those arranged in a curved relation to each other. The plurality of gaming machines 2 is installed on a plurality of respectively associated gaming machine bases 3. Referring to FIG. 3, there is shown a pair of belt conveyors 4(m) and 4(m+1) [m is an integer], a coin carrier of escalator type (coin dispenser) 6 (FIG. 4) as a coin feeder, and a controller 7 (FIG. 5) are provided within each of the gaming machine bases 3, as will be described later with respect to FIGS. 3 to 5.

As shown in FIGS. 1 to 3, a corner cover 8 is provided in an interval of the gaming machine bases 3 which is positioned at an angle of the carousel 1. Further, at an end of the carousel, as shown in FIGS. 4 and 5, there are provided a coin washer 9, a central control unit (CCU) 10 which consists of a microcomputer, and a coin-washer unit case 12 housing a coin carrier of escalator type 11.

Referring to FIG. 2, at a location above the coin-washer unit case 12, there provided a door 13 of a storage portion housing central control unit 10 (not shown in this figure) therein, a door 15 for collecting old coins from a coin storage tank 14 (FIG. 5) in coin washer 9 (FIG. 4) for providing new coins, and a door 17 for facilitating installation and removal of coin washer 9 at the front of coin-washer unit case 12. Doors 13, 15, and 17 are provided with locking devices, not shown, for preventing unauthorized access from the outside. In addition, a tower light 18 for indicating abnormality or other states in operations is provided at the top end of coin-washer unit case 12; the tower light could be multi-colored, and provide, for example, a red light to indicate an abnormal operation, a yellow color to indicate that maintenance is required, and a blue color to indicate normal operation.

Referring to FIG. 3, a plurality of belt conveyors 4(m) [m=1, 2, . . . n] are arranged as each pair of the conveyors are disposed linearly or with a predetermined angle respectively within each gaming machine base 3, whereby the carousel forms a coin conveyor having a loop configuration, and conveys the coins (not shown) supplied or collected for each gaming machine 2. As will be described later, the first belt conveyor 4(m) is positioned to carry the coins into each gaming machine base 3 turns into the first conveyor which receives the coins from coin providing side and conveys them, and, a second belt conveyor 4(m+1) [when $m \leqq n-1$] positioned on the side where the coins are carried from inside of each gaming machine base 3 turns into the second conveyor which receives the coins fed from the first conveyor and conveys them to the side of the coin carrier 6 of the escalator type as the coin feeder.

Figure 4:
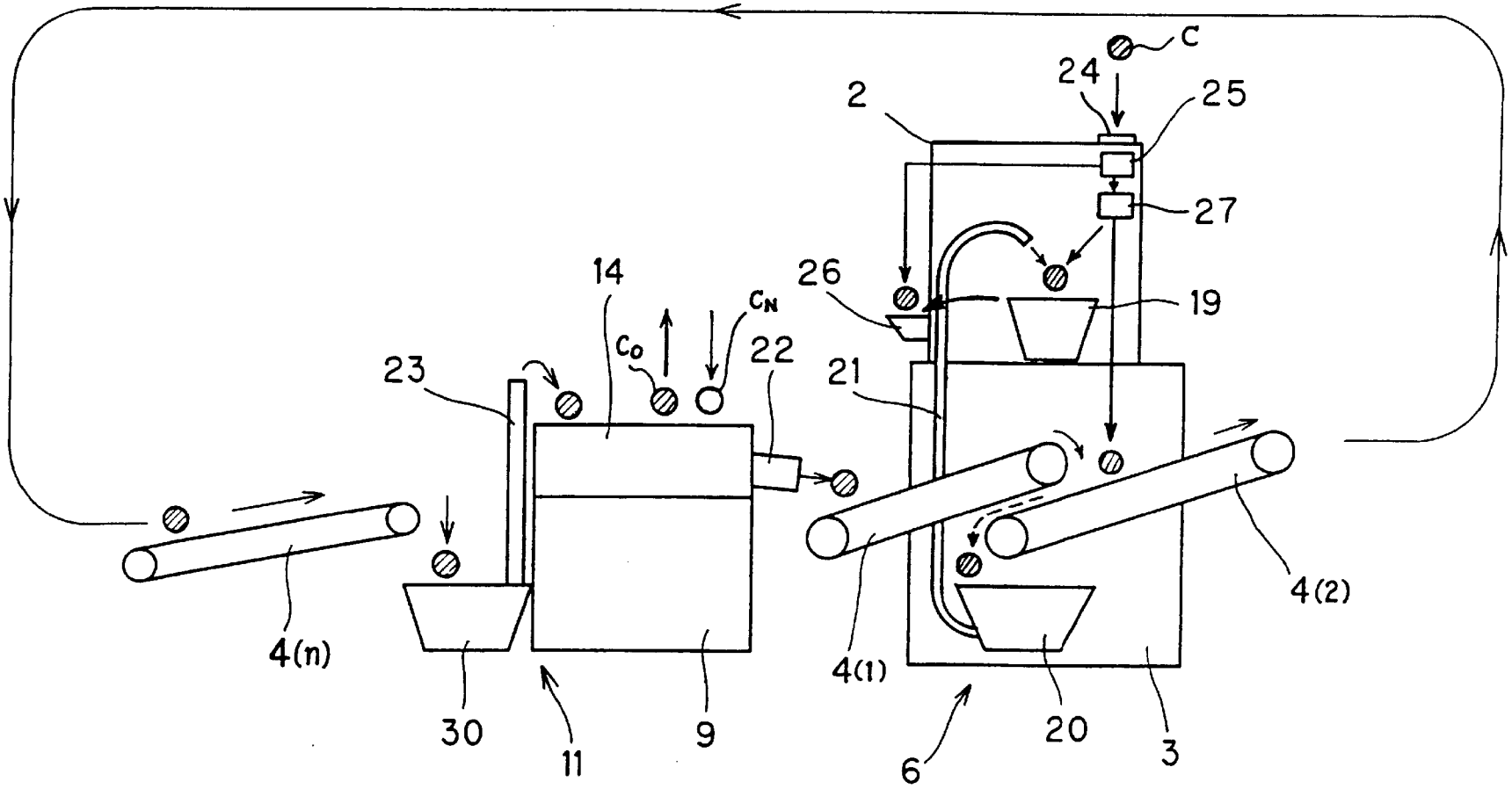
FIG. 4 shows the route of the coins moving in the coin supply and collection system of FIG. 2.
Figure 5:
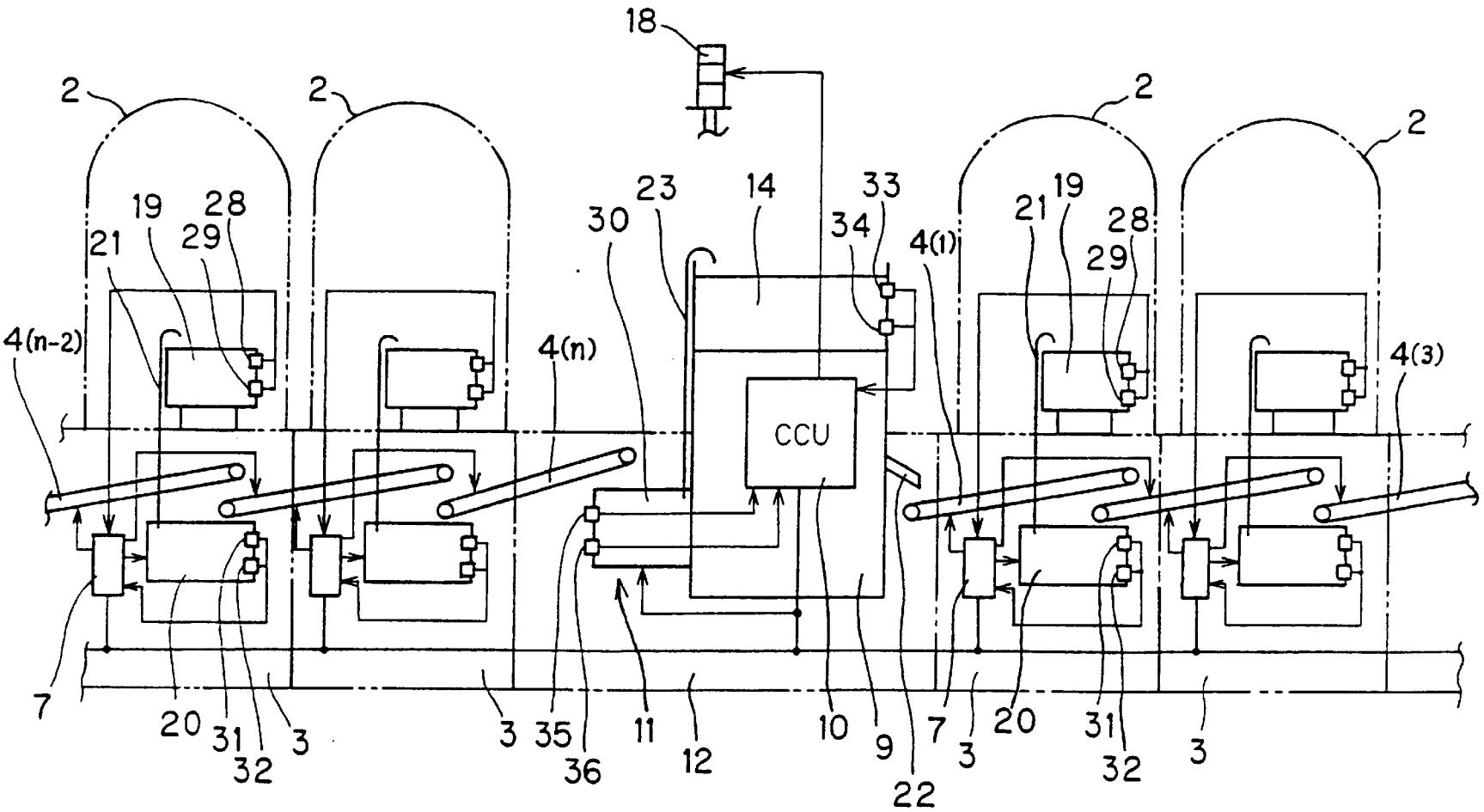
FIG. 5 shows the structural relationships between the belt conveyors and the feeders of the coins into the gaming machines.

Referring to FIGS. 4 and 5, a hopper 19 is shown for paying the coins out to a coin tray 26 as required, within gaming machine 2. In addition, the coin carrier of the escalator type 6 consists of a hopper portion 20 provided below the belt conveyors 4(m) and 4(m+1) within a gaming machine base 3, and an escalator portion 21 which consists of a guide rail that forms a path for the coins that are fed from the hopper portion 20 to the hopper 19 within gaming machine 2.

Within coin washer 9, coin storage tank 14 is provided for paying the coins out of a coin outlet 22 as required. Further, similar to the above-mentioned coin carrier 6, the escalator type coin carrier 11 housed within the coin-washer unit case 12 consists of a hopper portion 30 for storing the coins which had been conveyed from a last belt conveyor 4(*n*), and an escalator portion 23 which consists of a guide rail that forms a path for the coins that are fed from the hopper portion 30 to the coin storage tank 14 within the coin washer 9.

Referring to FIG. 4, the arrows show the direction of movement of the coins. First, in either of the gaming machines 2 of FIG. 1, whether a coin C deposited by a player via a coin entry slot 24 is suitable or not is determined by a selector 25. As a result of the determination, an unsuitable coin is returned to the coin tray 26, and gaming operations are not executed. On the other hand, a suitable coin is distributed to the hopper 19 within gaming machine 2 or second belt conveyor 4(m+1) [m=1, . . . ] for the gaming machine 2, depending upon circumstances, by a diverter 27 provided at a lower step of selector 25.

The coin which has been deposited into gaming machine 2 is diverted into hopper 19 within the gaming machine, when hopper 19 has been short of the coins, e.g., a jack pot has occurred in the game and a great number of coins are paid out to the coin tray 26. On this occasion, the controller 7 of FIG. 5 drives the hopper portion 20 of the escalator type coin carrier 6, and feeds the coin from the hopper portion 20 via the escalator portion 21 into the hopper 19 within the gaming machine 2. When the hopper portion 20 has been short of the coins, the controller 7 drives the second belt conveyor 4(m+1) for the gaming machine 2 in the opposite direction of the first belt conveyor 4(m), i.e., in the direction shown with an arrow of a broken line in FIG. 4, and feeds the coin on the second belt conveyor 4(m+1) into the hopper portion 20. Then, the belt conveyor 4(m+1) turns into the second conveyor which receives the coin fed from the belt conveyor 4(m) as the first conveyor and conveys it to the coin feeder of the gaming machine 2.

The coin which has been deposited into the gaming machine 2 is diverted into the second belt conveyor 4(m+1), when the hopper 19 within the gaming machine 2 is filled with the coins, and a signal indicative of an overflow is delivered to the controller 7 from a level sensor 28 (FIG. 5) provided in the hopper 19 within the gaming machine 2 as will be described later. On this occasion, the diverter 27 diverts the coin which has been fed through the escalator portion 21, not into the hopper 19 within the gaming machine 2, onto the second belt conveyor 4(m+1). Further, the controller 7 drives two of the belt conveyors 4(m) and 4(m+1) in the direction of the arrows, and feeds the coin from the first belt conveyor 4(m) through the second belt conveyor 4(m+1) to a succeeding gaming machine. In this case, the second belt conveyor 4(m+1) turns into the first conveyor for the succeeding gaming machine.

Since the first belt conveyor 4(m) for the gaming machine 2 is usually driven in the direction for feeding the coins therein, so far as a pair of the belt conveyors 4(m) and 4(m+1) of each gaming machine base 3 is driven together in a predetermined direction, the coin C which has been dropped onto the belt conveyors 4(m) and 4(m+1) is conveyed sequentially through each of the belt conveyors, as shown with the arrows of a loop shape in FIG. 4, and finally the coin is fed to the escalator type coin carrier 11 provided at a side of the coin washer 9.

The coin C which has been fed to the hopper portion 30 of the escalator type coin carrier 11 is fed from the hopper portion 30 into the coin washer 9 by the escalator portion 23, and is washed therein. The coin which has been washed is ejected via the coin outlet 22 of the coin washer 9 onto the first belt conveyor 4(*l*) for the first gaming machine 2, and is conveyed from the belt conveyor 4(*l*) as mentioned above. In addition, for the coin washer 9, a worker may perform a task of opening the above-mentioned door 15 (FIG. 2) to collect old coins $C_O$ and feeding new coins $C_N$, e.g., once a day.

As shown in FIG. 5, a pair of upper and lower level sensors 28 and 29 is provided in the hopper 19 within each gaming machine 2. A pair of upper and lower level sensors 31 and 32 is also provided in the hopper portion 20 of each of the escalator type coin carriers 6. Further, a pair of upper and lower level sensors 33 and 34 is provided in the coin storage tank 14 of the coin washer 9, and a pair of upper and lower level sensors 35 and 36 is also provided in the hopper portion 30 of the escalator type coin carrier 11. These level sensors detect whether or not a quantity of the coins is within predetermined limits.

For example, when the quantity of the coins which have been stored in the hopper 19 of the gaming machine 2 is above the upper level sensor 28, the level sensor 28 delivers a detection signal indicative of an overflow. In response to the signal, as mentioned above, since the diverter 27 diverts the coins which have been deposited into the gaming machine 2 onto the second belt conveyor 4(m+1), and then also the controller 7 drives the belt conveyors 4(m) and 4(m+1) in the predetermined direction, the coins are fed from the first belt conveyor 4(m) through the second belt conveyor 4(m+1) to a succeeding gaming machine.

Afterward, when the quantity of the coins within the hopper portion 20 drops below the lower level sensor 32 as the coins are carried out of the hopper portion 20 of the escalator type coin carrier 6, the lower level sensor 32 does not deliver a coin detection signal. Therefore, as mentioned above, the controller 7 drives the second belt conveyor 4(m+1) in the opposite direction, i.e., the controller inverts the second belt conveyor 4(m+1), and then feeds the coins into the hopper portion 20 from the belt conveyor 4(m+1). This operation continues until the quantity of the coins within the hopper portion 20 is above the upper level sensor 31. Then, when the upper level sensor 31 delivers a detection signal indicative of an overflow, the controller 7 returns driving of the second belt conveyor 4(m+1) in a predetermined direction, i.e., the controller 7 drives the second belt conveyor 4(m+1) in the regular direction. The steps in the operation of the belt conveyor 4(m+1), responsive to the quantity of the coins within the hopper portion 20 as described above are shown in a flow chart of FIG. 6. This will be described in detail later.

Further, in the case that the lower level sensor 32 in the hopper portion 20 detects the coins, when the lower level sensor 29 of the hopper 19 within the gaming machine 2 does not detect the coins, the controller 7 drives the hopper portion 20 to feed the coins into the hopper 19 of the gaming machine 2. Then, when the coins have been accumulated in the hopper 19 of the gaming machine 2, and the upper level sensor 28 delivers a signal indicative of an overflow, the controller 7 stops driving the hopper portion 20 to stop supplying the coins. The steps in the operation of the escalator type coin carrier 6, responsive to the quantity of the coins within the hopper 19 of the gaming machine 2 as described above are shown in a flow chart of FIG. 7. This also will be described in detail later.

In coin-washer unit case 12, when the quantity of the coins which have been stored within the hopper portion 30 of the escalator type coin carrier 11 is above the lower level sensor 36, and the quantity of the coins which have been stored within the coin storage tank 14 falls below the upper level sensor 33, and lower level sensor 34 does not detect the coins, central control unit 10 drives the hopper portion 30 to feed the coins therein to the coin storage tank 14. The operations are executed until the upper level sensor 33 within the coin storage tank 14 comes to detect the coins.

Here, the steps in the operation of the second belt conveyor 4(m+1), responsive to the quantity of the coins within the hopper portion 20 provided on the gaming machine base 3 will be explained referring to FIG. 6.

First, the controller 7 determines whether a power source is on or not (at step ST1). When the power source is not on, the controller 7 does not perform the following operations. When the power source is on, the controller 7 determines whether or not some trouble has occurred in the system (at step ST2). These (the power source and the trouble) are determined by signals delivered from the central control unit 10. When there is a trouble referring to the latter determination, a display indicative of a trouble is activated. For example, a red lamp of the tower light 18 is made to light, and then a code (trouble code) according to nature of the trouble is indicated on a control panel of the central control unit 10. Accordingly, a manager of the system is able to know the nature of the trouble by opening the door 13 shown in FIG. 1 and seeing the display of the control panel.

When there is no trouble, the controller 7 determines the ON/OFF state of the lower level sensor 32 of the hopper portion 20 (at step ST3). As mentioned above, the lower level sensor 32 detects whether or not the quantity of the coins within the hopper portion 20 has become lower than a lower limit, and when the quantity (height) of the coins is above the lower level sensor 32, it is ON.

Accordingly, when the lower level sensor 32 is ON, the controller 7 drives the second belt conveyor 4(m+1) together with the first belt conveyor 4(m) in the direction of conveying the coins to a succeeding belt conveyor 4(m+2) (at step ST4). Therefore, the coins are conveyed from the second belt conveyor 4(m+1) to the succeeding gaming machine. When the quantity of the coins within the hopper portion 20 decreases and the level sensor 32 becomes OFF, the controller 7 drives the second belt conveyor 4(m+1) in the opposite direction (at step ST5). Then, the coins are conveyed from the second belt conveyor 4(m+1) into the hopper portion 20, and are stored therein.

Afterward, the controller 7 determines the ON/OFF state of the upper level sensor 31 within the hopper portion 20 (at step ST6). As mentioned above, the level sensor 31 detects whether or not the quantity of the coins within the hopper portion 20 has become above an upper limit, and when the quantity (height) of the coins is above the upper level sensor 31, it becomes ON.

Accordingly, so far as the upper level sensor 31 is OFF, the controller 7 continues driving the second belt conveyor 4(m+1) in the opposite direction, and when the upper level sensor 31 becomes ON, the controller 7 returns driving of the second belt conveyor 4(m+1) in a predetermined direction (at step ST4). Therefore, the coins are conveyed from the second belt conveyor 4(m+1) to the succeeding gaming machine again.

Figure 7:
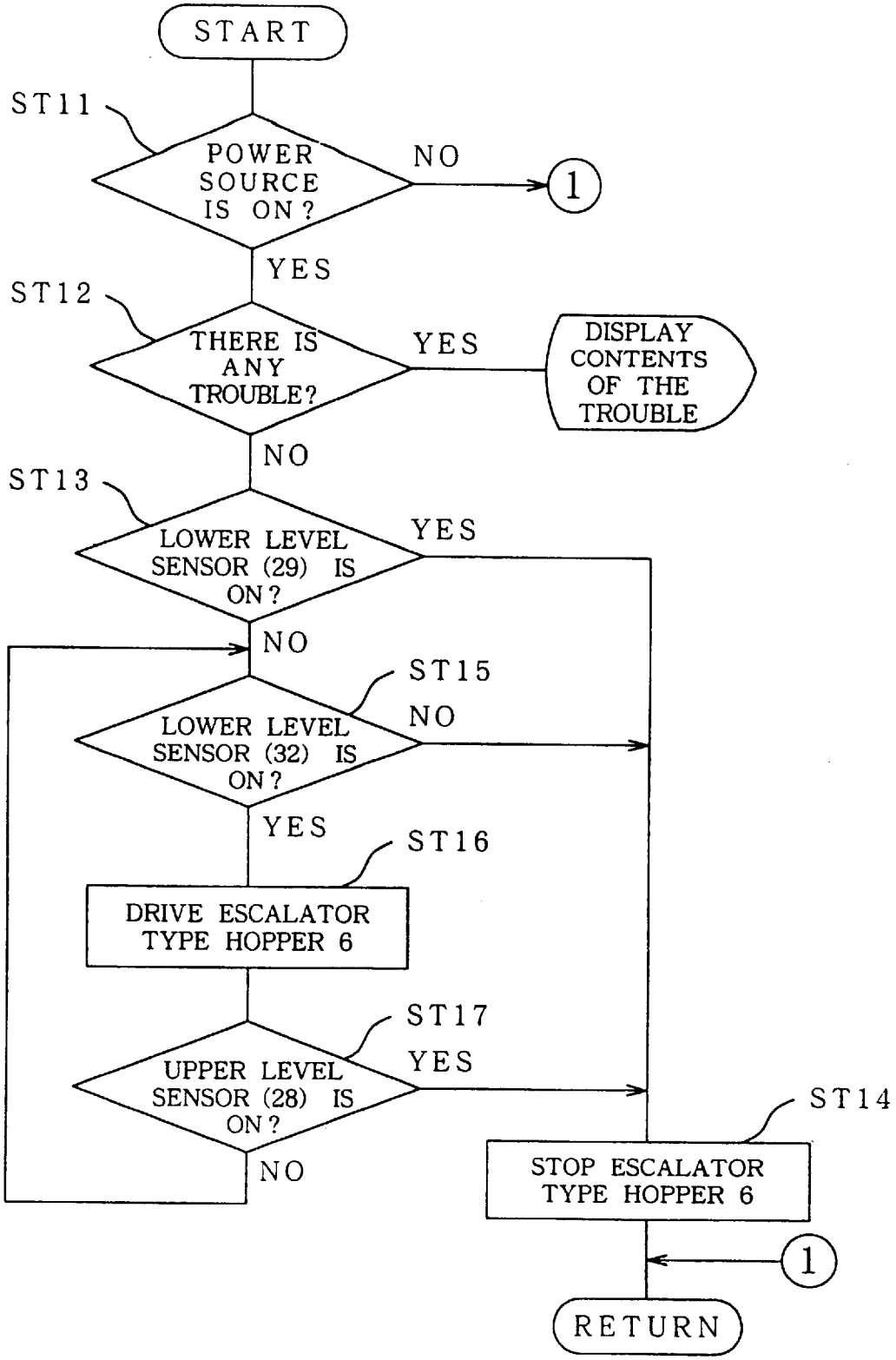
FIG. 7 is a flow chart showing the steps in the operation of a coin carrier of the escalator type, responsive to the quantity of the coins in a hopper of the gaming machine.

Secondly, the steps in the operation of escalator type coin carrier 6, responsive to the quantity of the coins within the hopper 19 of the gaming machine 2 will be explained referring to FIG. 7.

Figure 6:
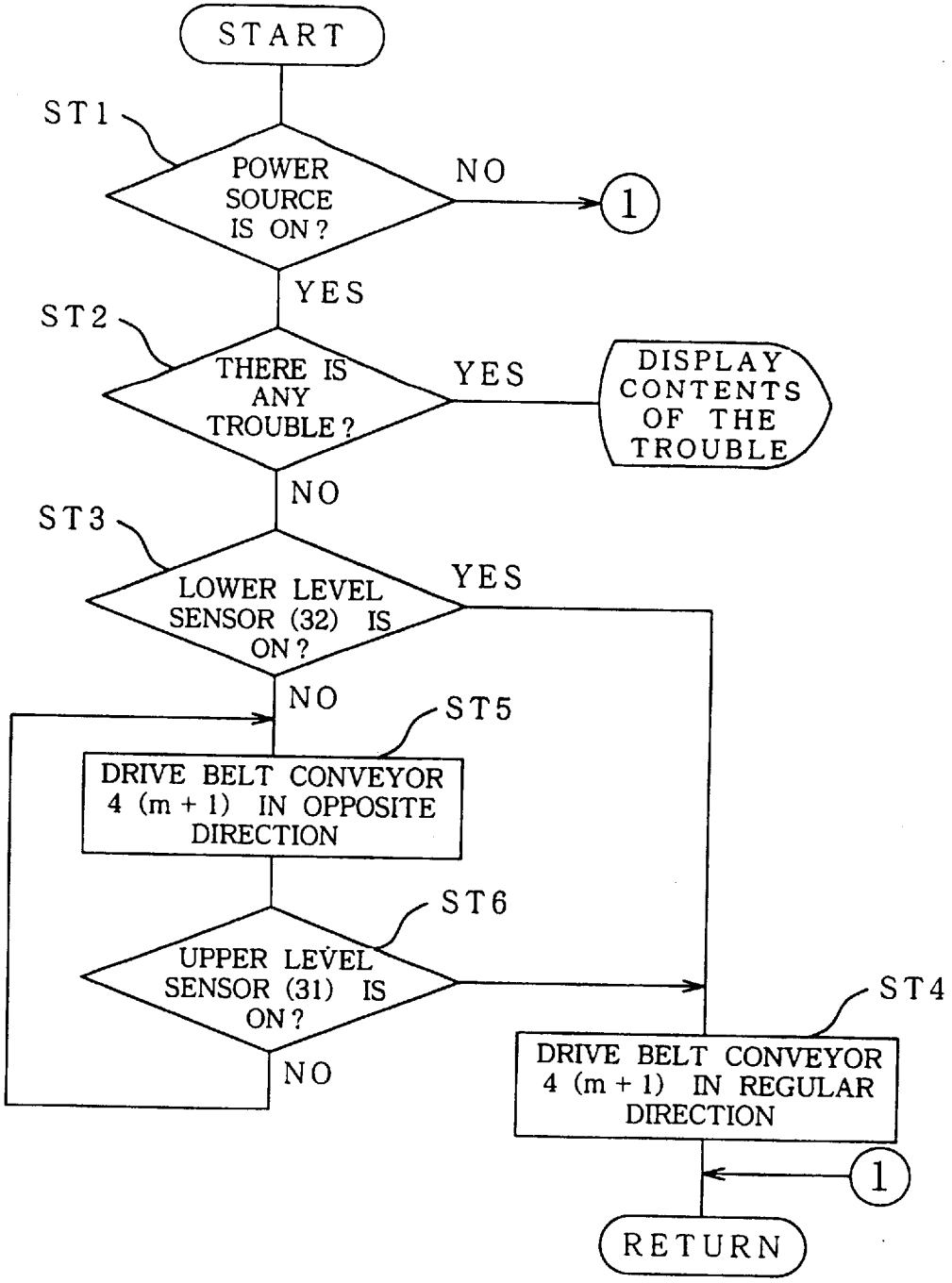
FIG. 6 is a flow chart showing the steps in the operation of the belt conveyor, responsive to a quantity of the coins in a hopper portion of the coin feeder.

First, in a manner similar to the operations described with respect to FIG. 6, the controller 7 determines whether or not the power source is on (at step ST11). When the power source is on, whether or not some trouble has occurred in the system is determined (at step ST12). Then, when there is trouble, a display as described above is executed according to the nature of the trouble. On the other hand, when there is no trouble, the controller 7 determines the ON/OFF state of the lower level sensor 29 within the hopper 19 of the gaming machine 2 (at step ST13). As mentioned above, the level sensor 29 detects whether or not the quantity of the coins within the hopper 19 of the gaming machine 2 has fallen below the lower limit, and when the quantity (height) of the coins is above the lower level sensor 29, it is ON.

Accordingly, when the lower level sensor 29 is ON, the controller 7 does not drive the hopper portion 20 of the escalator type coin carrier 6 to be stopped (at step ST14). Therefore, the coins are not fed to the hopper 19 of the gaming machine 2. When a win occurs in the gaming machine 2 in this state, the coins to be paid out for the player are ejected onto the coin tray 26 via the hopper 19 of the gaming machine 2. Thus, when the quantity of the coins within the hopper 19 of the gaming machine 2 is decreasing, and the lower level sensor 29 becomes OFF, the controller 7 determines the ON/OFF state of the lower level sensor 32 within the hopper portion 20 (at step ST15). As mentioned above, the level sensor 32 detects whether or not the quantity of the coins within the hopper portion 20 has dropped below the lower limit, and when the quantity (height) of the coins is below the lower level sensor 32, it becomes OFF.

Accordingly, when the lower level sensor 32 is OFF, the controller 7 does not drive the hopper portion 20 of the escalator type coin carrier 6 to be stopped (at step ST14), but when the lower level sensor 32 is ON, the controller 7 drives the hopper portion 20 (at step ST16). Therefore, the coins are fed from the hopper portion 20 to the hopper 19 of the gaming machine 2. The operations are executed until the upper level sensor 28 in the hopper 19 of the gaming machine 2 becomes ON.

Therefore, the controller 7 determines the ON/OFF state of the upper level sensor 28 (at step ST17). So far as the upper level sensor 28 within the hopper 19 of the gaming machine 2 is OFF and the lower level sensor 32 within the hopper portion 20 is ON, the controller 7 continues driving the escalator type coin carrier 6, and stops it when the upper level sensor 28 within the hopper 19 of the gaming machine 2 has become ON (at step ST14).

Figure 8:
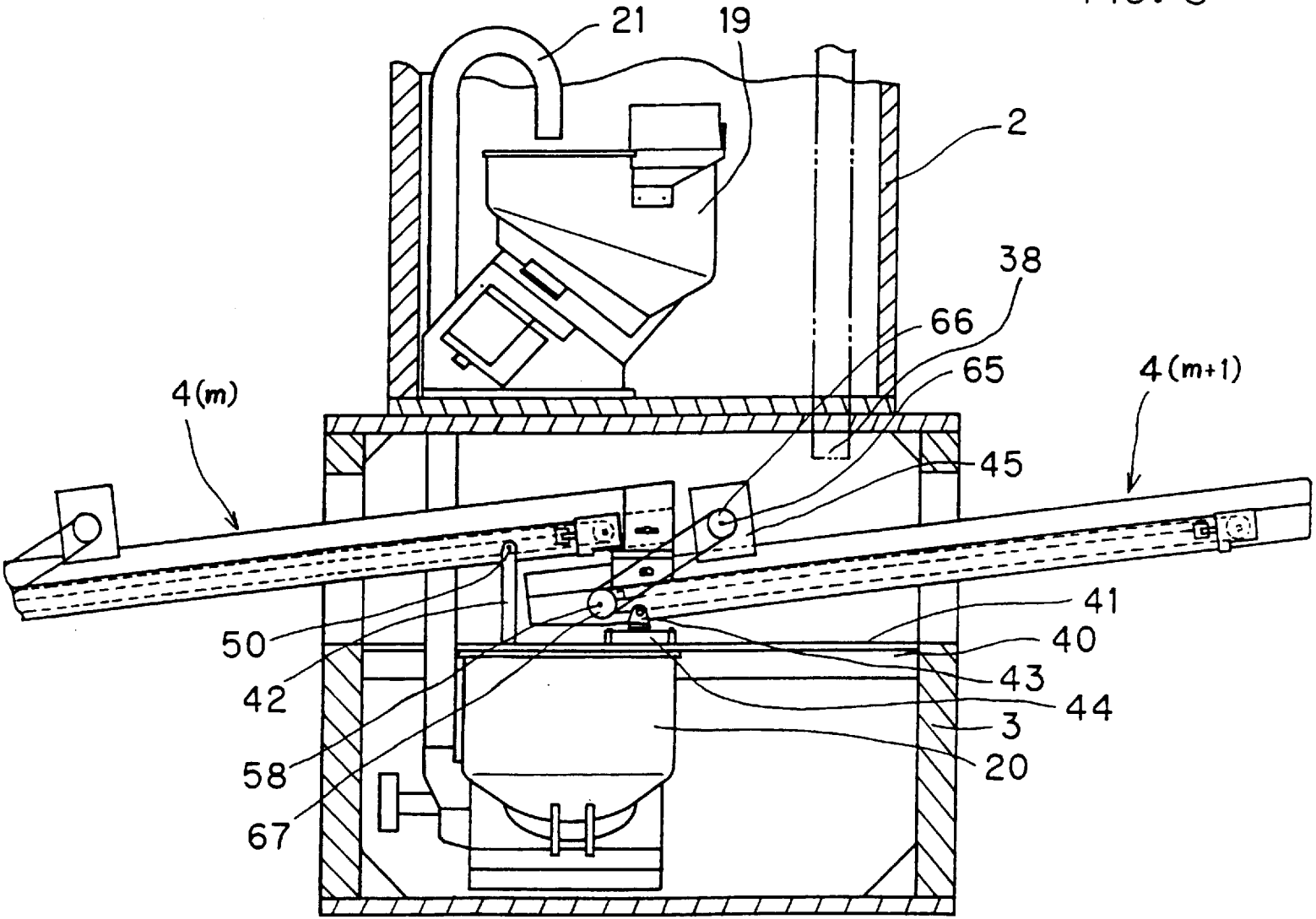
FIG. 8 is a partially sectional view of a front face showing the structure of the belt conveyors and the coin carrier of the escalator type within the gaming machine and a gaming machine base.
Figure 9:
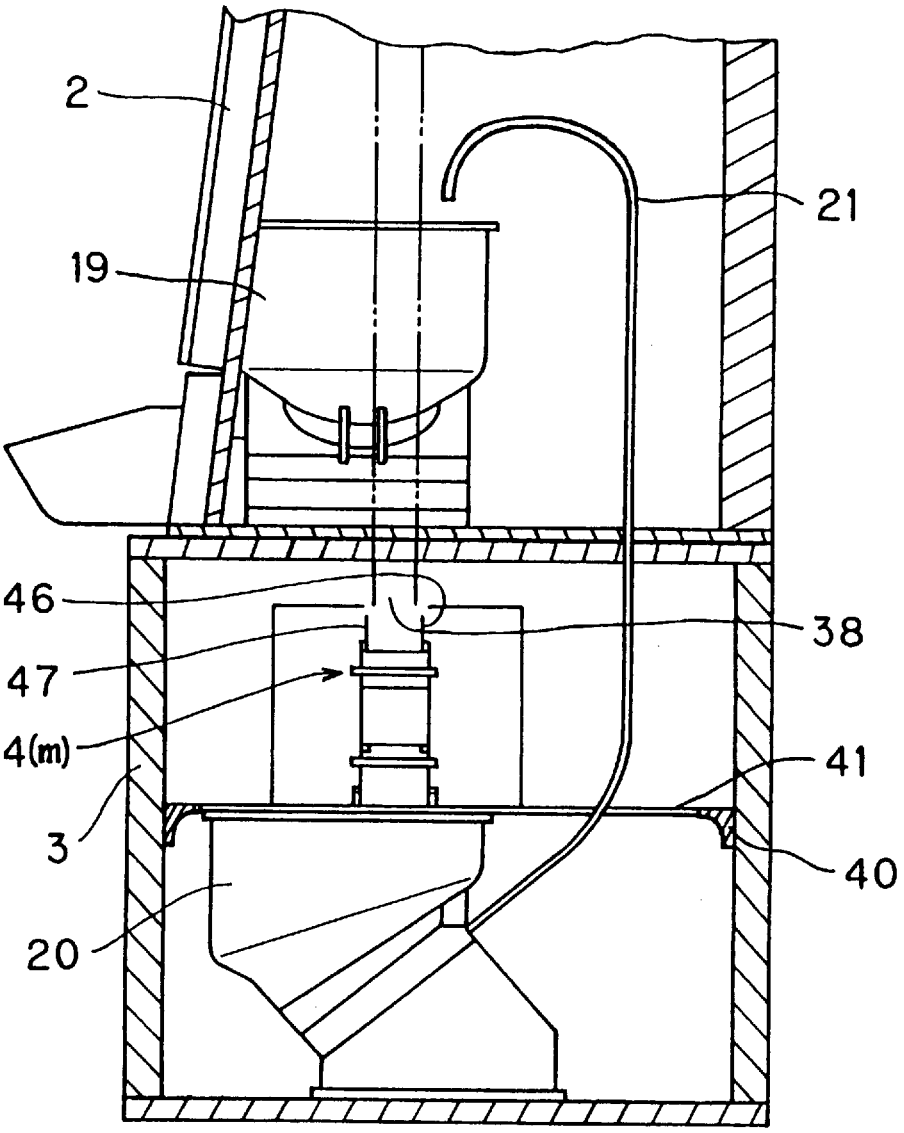
FIG. 9 is a partially sectional side view of FIG. 8.
Figure 10:
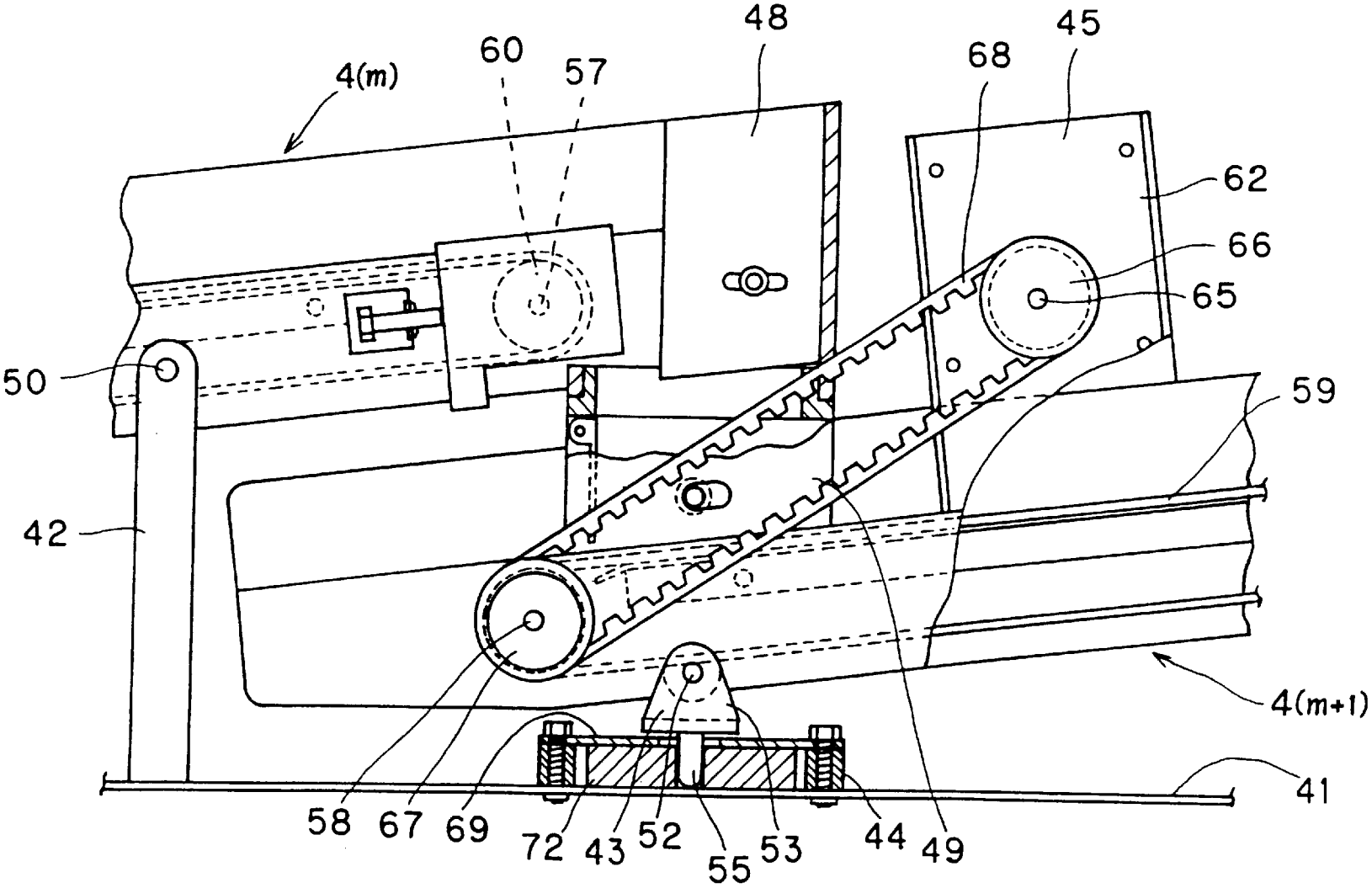
FIG. 10 shows a connecting portion of the belt conveyors adjacent each other in FIG. 8.

FIG. 8 is a partially sectional view showing construction of a pair of the belt conveyors 4(m) and 4(m+1) and the escalator type coin carrier 6 for the gaming machine 2, FIG. 9 is a sectional view taken from the right side of the construction of FIG. 8, and FIG. 10 is an enlarged view of a connecting portion of the pair of the belt conveyors of FIG. 8.

Referring to FIG. 8, a coin dropping outlet 38 is provided at the bottom of the gaming machine 2 for dropping and feeding the coins from the diverter 27 onto the second belt conveyor 4(m+1) which is disposed within the gaming machine base 3 positioned beneath the gaming machine 2. As will be explained in detail later, within the gaming machine base 3, the pair of the belt conveyors 4(m) and 4(m+1) is supported by a supporting leg 42, a positioning member 43, and a floating base mechanism 44, on a floating base 41 installed on a frame 40 which is substantially horizontal. The floating base mechanism 44 is a pedestal which attaches each of the belt conveyors 4(m) and 4(m+1) thereto to be movable in the direction of a plane to be adjusted as will be described.

Figure 11:
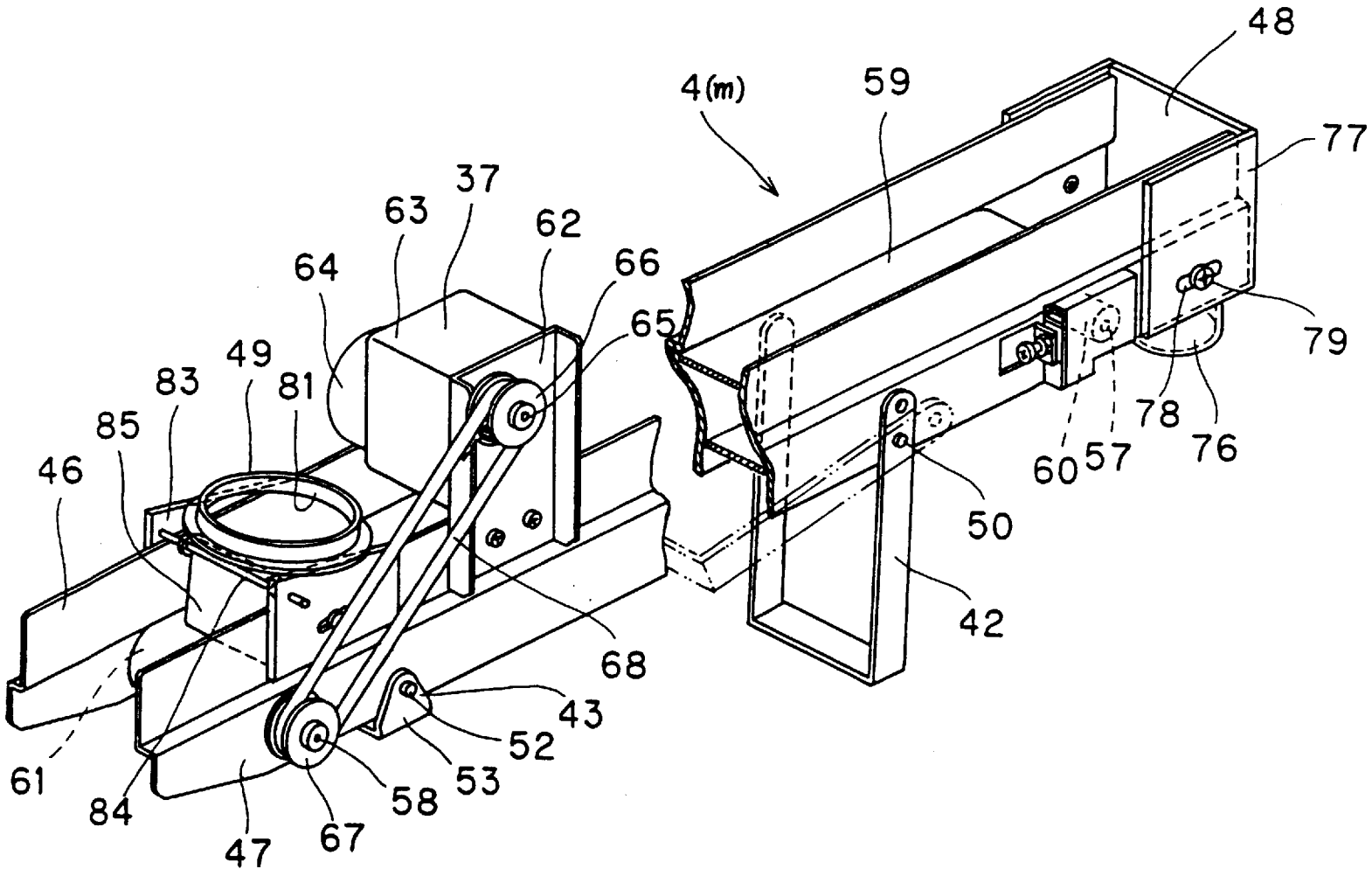
FIG. 11 is a perspective view of substantially the entire structure of a belt conveyor arrangement constructed in accordance with the invention.
Figure 12:
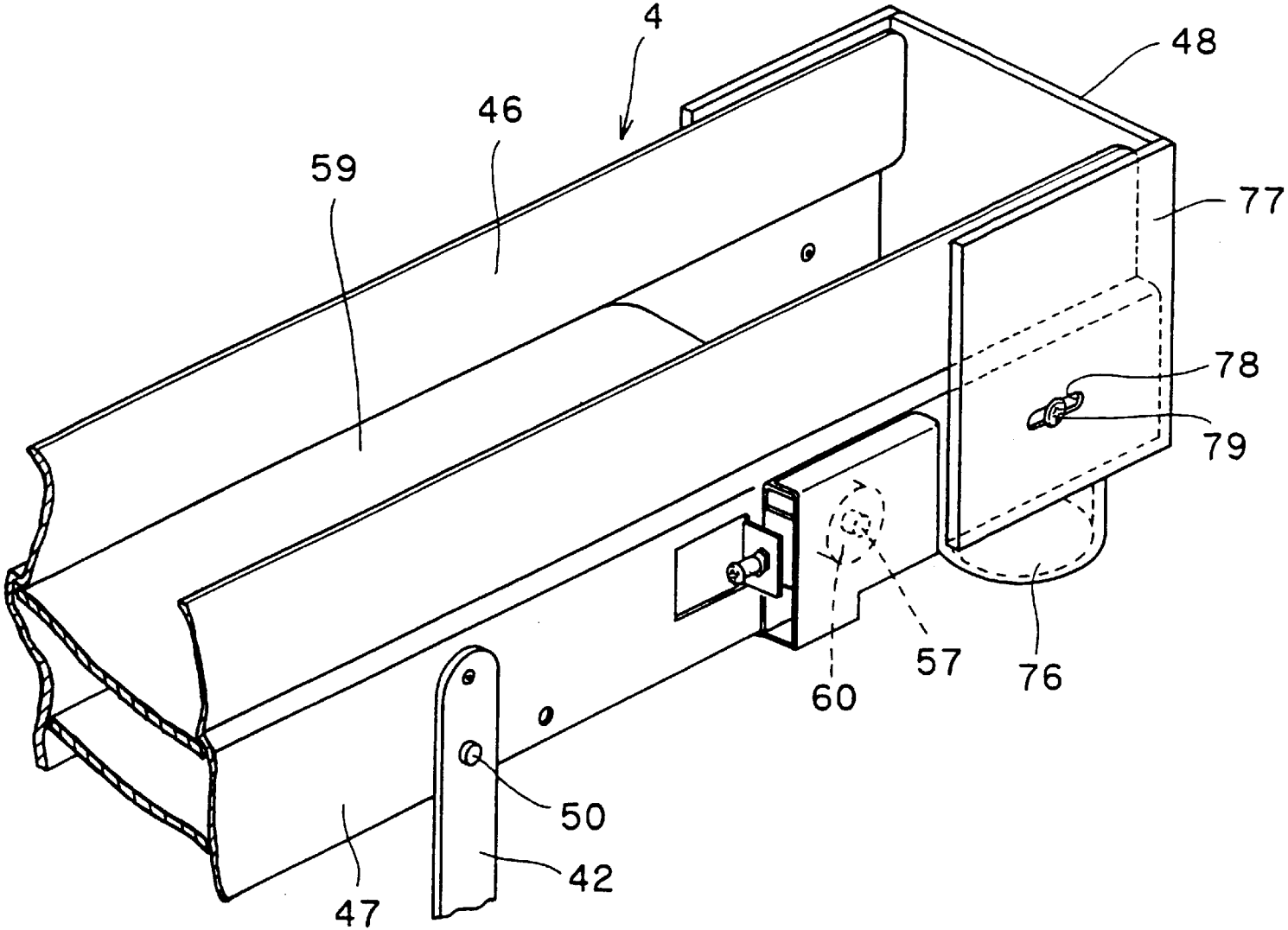
FIG. 12 is a enlarged perspective view of an end of the belt conveyor of FIG. 11.
Figure 13:
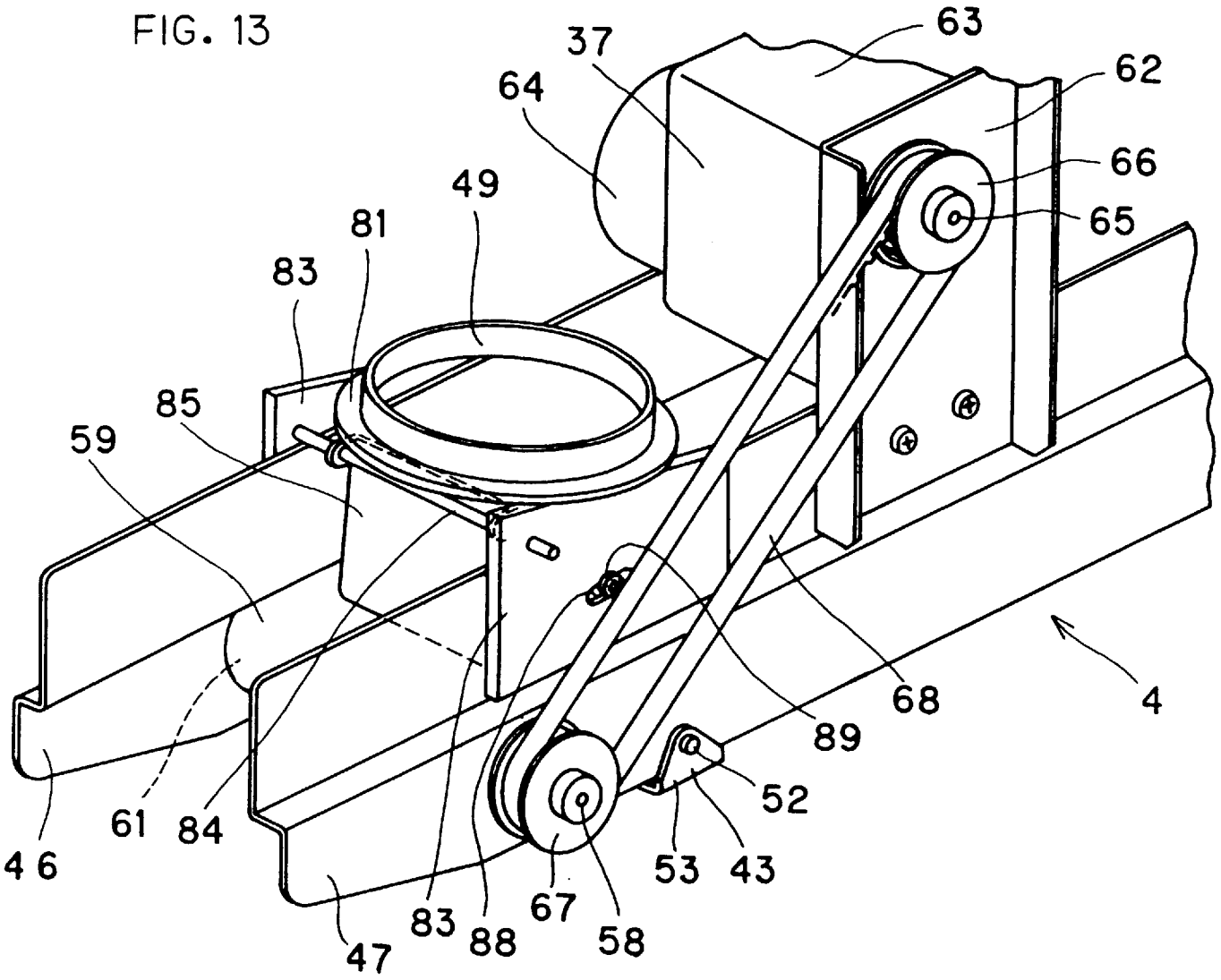
FIG. 13 is a enlarged perspective view of the other end of the belt conveyor of FIG. 11.

FIG. 11 is an external perspective view of the belt conveyor 4(m) or 4 (m+1), and FIG. 12 is an enlarged perspective view of an end of the same belt conveyor. FIG. 13 is an enlarged perspective view of the other end of the same belt conveyor. In addition, the pair of the belt conveyors has been distinguished into the first belt conveyor 4(m) and the second belt conveyor 4(m+1) as described above. However, since both belt conveyors have substantially identical structures, only the first belt conveyor 4(m) will be explained hereinafter.

First, the belt conveyor 4(m) has side plates 46 and 47 at both sides, which are formed by a rectangular plate extending longitudinally. A member (hereinafter, referred to as an upper joint member) 48 is attached from above at an end of each of the side plates 46 and 47, and a further member (hereinafter, referred to as a lower joint member) 49 is attached from underneath at the other end of each of the side plates, respectively. The upper joint member 48 of the belt conveyor 4(m−1), not shown, which is positioned at the right in FIG. 11 is joined from above with the lower joint member 49 of the belt conveyor 4(m), and also, the upper joint member 48 of the belt conveyor 4(m) is joined from above with the lower joint member 49 of the belt conveyor 4(m+1), not shown, at the right in FIG. 11. The upper joint member 48 and the lower joint member 49 form a connector which is necessary to connect a plurality of belt conveyors as coin conveyor sequentially, similar to the above-mentioned carousel. These structures will be described in detail referring to FIGS. 16 and 17.

At a side of an end of each of the side plates 46 and 47 (at the right of FIG. 11), the supporting leg 42 having a U shape is provided which supports each side plate in a manner rotatable with a support shaft 50 inserted from outside through each side plate in the center. The supporting leg 42 rotates in a range of a predetermined angle with the support shaft 50 as a fulcrum and is able to support keeping a certain height of the side of an end of the belt conveyor 4(m). Further, since the supporting leg 42 can be set at a place abutted on a base of the belt conveyor 4(m) as shown in the dash-dotted lines in FIG. 11 as required, it does not disturb carrying of the belt conveyors.

Figure 14:
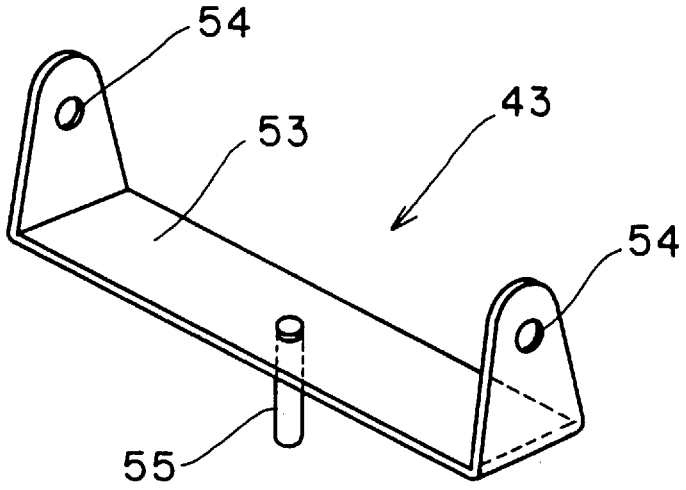
FIG. 14 is a perspective view of a positioning member.

At the side of the other end of each of the side plates 46 and 47 (at the left of FIG. 11), a positioning member 43 of abbreviated U shape is attached which is far lower than the supporting leg 42, but supports each side plate so as to be rotatable with a support shaft 52 inserted through each side plate in the center. The positioning member 43 consists of a strip 53 made of metal, the both ends of which being bent perpendicularly in the same direction as shown in FIG. 14. This member is provided with a hole 54 through which the support shaft 52 penetrates rotatively, on the both ends, and is also provided with a shaft portion 55 projecting out of a central portion of the strip 53 in the direction opposite to the both ends. A projection end of the shaft portion 55 has a rounded shape so as to be easily inserted into an insert hole 56 (FIG. 15) of a floating plate 72.

Since the height of the above supporting leg 42 to support the belt conveyor is different from that of the positioning member 43, the belt conveyor 4(m) is supported to be inclined as shown.

At the both ends of each of the side plates 46 and 47 of the belt conveyor 4(m), rollers 60 and 61 for driving a belt 59 are arranged in synchrony with shafts 57 and 58 arranged to be rotatable. A belt 59 is hung around the interval between the rollers 60 and 61.

The side plate 47 at the front of the arrangement shown in FIG. 11 is attached with a support plate 62 rising substantially vertically at the left position thereof, and a driving mechanism 37 having a reduction gear 63 and an electric motor 64 is fixed thereto. The reduction gear 63 reduces a rotational speed of the electric motor 64 and provides an output. An output shaft 65 of the electric motor 64 projects outward of a hole, not shown, which is provided at the support plate 62, and a pulley 66 is fixed to an end of the shaft. A pulley 67 as the above pulley 66 is fixed to the shaft 58, and a torque of the output shaft 65 of the driving mechanism 37 is transmitted to the shaft 58 by a toothed belt 68 installed around the pulleys 66 and 67, whereby a roller 61 rotates to drive the belt 59. The driving mechanism 37 rotates output shaft 65 in two directions, and the driving is controlled according to the sequence of steps shown in the flow chart of FIG. 6.

Figure 15:
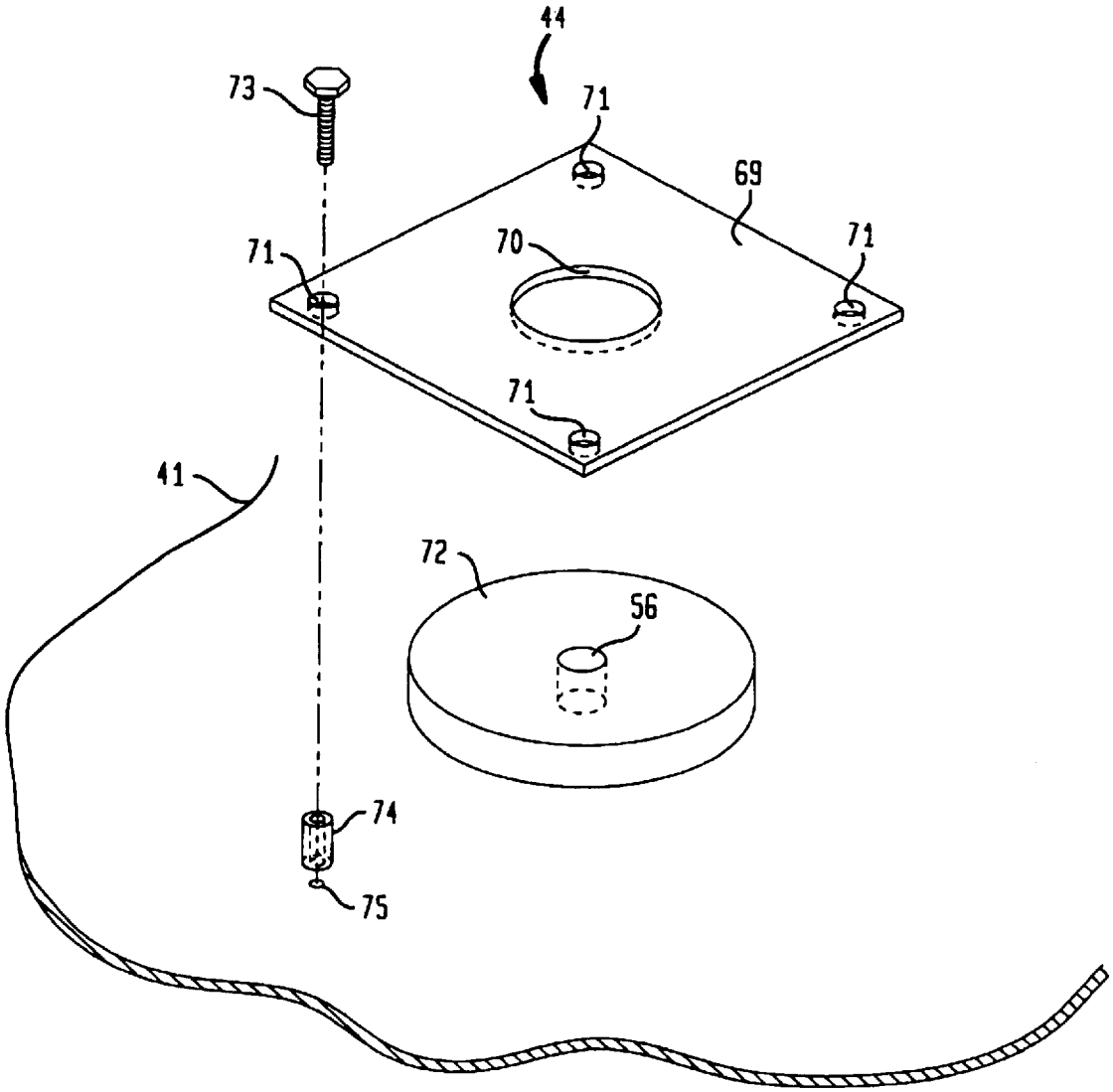
FIG. 15 is a perspective view showing the structure of an illustrative floating base mechanism.

FIG. 15 is a perspective view showing a structure of the floating base mechanism 44. This mechanism operates as a pedestal on the above floating base 41 to attach each belt conveyor to be movable in the direction of a plane to be adjusted, which is provided with a positioning plate 69 and a floating plate 72.

The positioning plate 69 is a substantially square plate having a circular through hole 70 in the center and fixing holes 71 for inserting bolts 73 at the four corners. The floating plate 72 consists of a disk-shaped member having a smaller diameter than a distance of an interval of the two fixing holes 71 at a diagonal position on the positioning plate 69, and has a insert hole 56 which can insert the shaft portion 55 of the above positioning member 43 (FIG. 14) so as to be rotatable about the center thereof. The through hole 70 at the center of the positioning plate 69 is formed wider than the insert hole 56 of the floating plate 72.

The positioning plate 69 is mounted on the floating plate 72 as the through hole 70 is positioned at the above of the insert hole 56 of the floating plate 72. Further, around the floating plate 72, a cylindrical spacers 74 are installed between fixing holes 71 of the positioning plate 69 and the floating base 41. The bolts 73 are put through the fixing holes 71 of the positioning plate 69 and the spacer 74, and a lower end of each of the bolts is screwed into each of screw holes 75 of the floating base 41, whereby the positioning plate 69 is fixed on the floating base 41 as shown in FIG. 10. From above, the shaft portion 55 of the positioning member 43 is inserted through the insert hole 56 of the floating plate 72 so as to be rotatable.

Since the central through hole 70 of the positioning plate 69 which is fixed as mentioned above is formed wider than the insert hole 56 of the floating plate 72, and the spacer 74 is formed a little longer than a thickness of the floating plate 72, the floating plate 72 is able to be moved in a horizontal direction in a range such that the insert hole 56 does not disconnect from the through hole 70 of the positioning plate 69. Therefore, the positioning member 43 having the shaft portion 55 inserted through the insert hole 56 of the floating plate 72 is able to be moved in the horizontal direction, and the position of the belt conveyor 4(m) can be adjusted.

Further, the belt conveyor 4(m) is rotatable in a direction of a plane with the shaft portion 55 of the positioning member 43 in the center, according to the floating base mechanism 44 and the positioning member 43.

Figure 16:
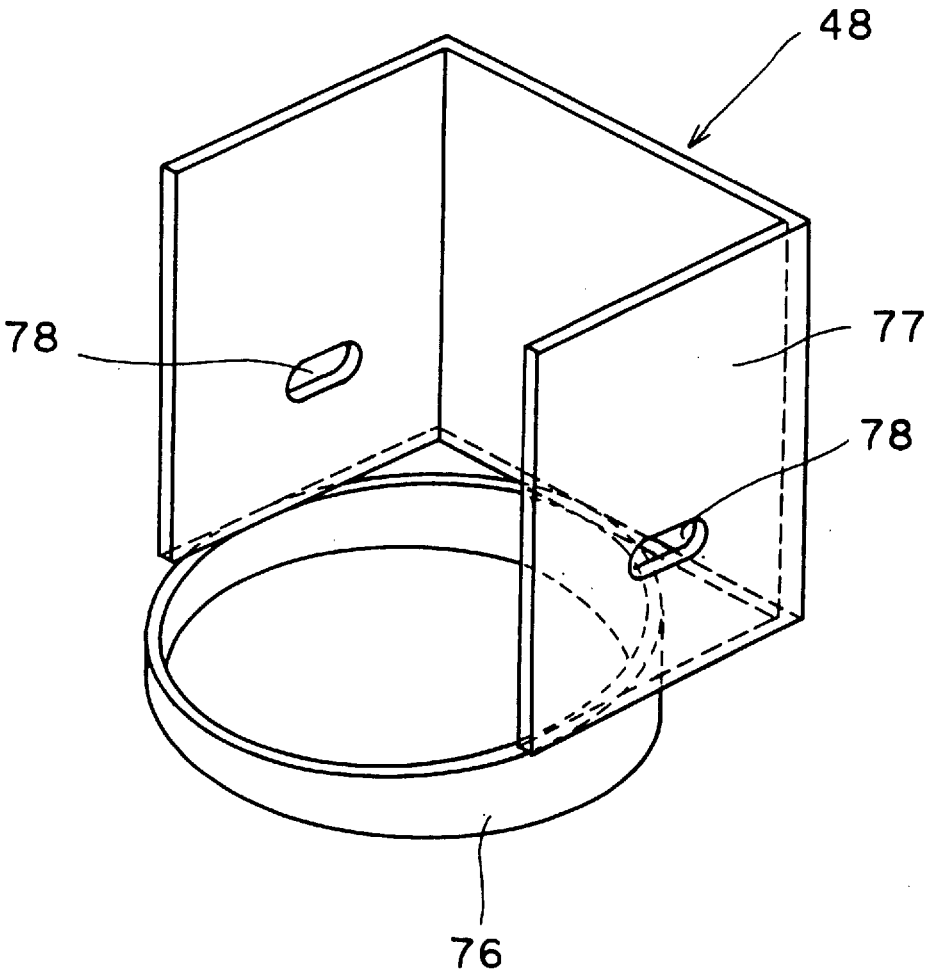
FIG. 16 is a perspective view of an upper joint member.

FIG. 16 is a perspective view of upper joint member 48 which connects a plurality of belt conveyors as mentioned above. The upper joint member 48 consists of a connecting portion 76 of annular shape which forms a path for the coins, and a cover portion 77 formed to be U-shaped. The upper joint member 48 is fixed to an end of the belt conveyor 4(m), at the right in the FIG. 16, as follows: an elongated slot 78 is provided through each of the side walls of the cover portion 77 which are arranged to register with screw holes, not shown, provided at each end of side plates 46 and 47 of the belt conveyor 4(m), respectively, and a screw 79 is screwed via the elongated slot 78, as shown in FIGS. 11 and 12.

Figure 17:
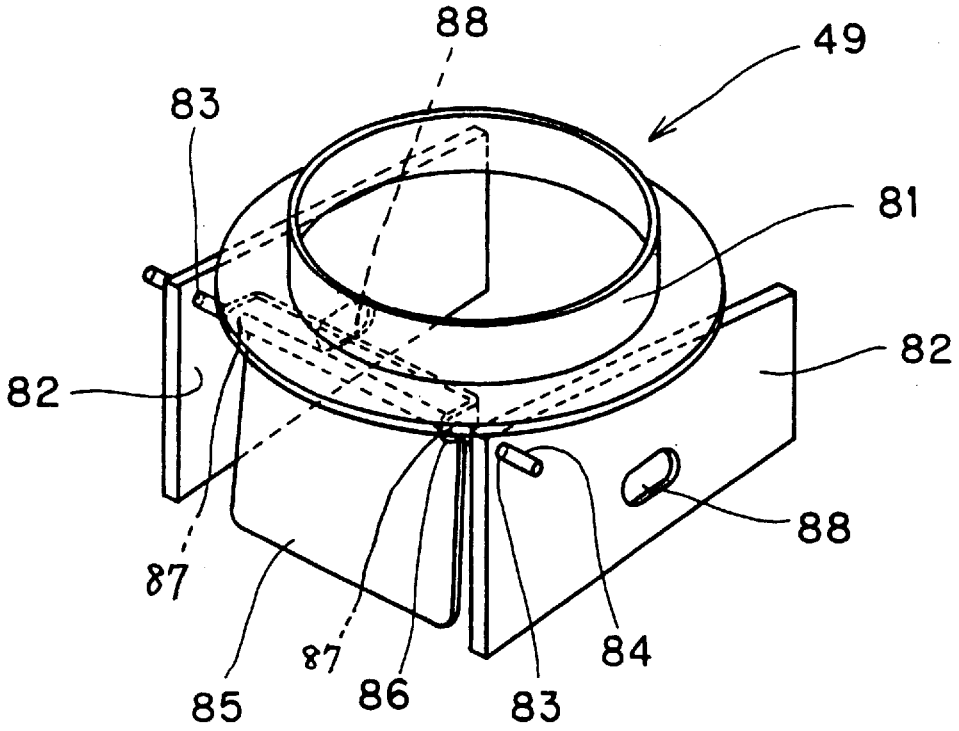
FIG. 17 is a perspective view of a lower joint member.

FIG. 17 is a perspective view of the lower joint member 49 as another means of connecting. This lower joint member 49 consists of a connecting member 81 of annular shape which forms the path of the coins, a pair of rectangular support plates 82 which is formed in synchrony with the underneath of the connecting portion 81 and is arranged in parallel in a predetermined interval respectively, a latitudinal shaft 84 which is supported by shaft holes 83 provided at a corner at a location above of these support plates 82 so as to be rotatable, and a rotatable plate 85 is rotatably attached to the latitudinal shaft 84 as a fulcrum.

In the lower joint member 49, the rotatable plate 85 has small pieces 86 which project out of upper ends of both sides of a square sheet. Through holes 87 like the shaft holes 83 are provided at two small pieces 86 with shaft 84 inserted its both ends through the through holes 87, therefore, the rotatable plate 85 is in a state of being suspended as shown in FIG. 17. In addition, at both ends of shaft 84, retaining rings, not shown, are mounted from outside of the two support plates 82 in order to prevent shaft 84 from falling out.

Each of the support plates 82 is provided with an elongated slot 88. When the lower joint member 49 is mounted to the other end of the belt conveyor 4(m) as shown in FIGS. 11 and 13, each elongated slot 88 is located outside of screw holes, not shown, which are provided at the side plates 46 and 47, and screws 89 are screwed from outside of each of the elongated slots 88 into the screw holes of the side plates 46 and 47. Thus, the lower joint member 49 is fixed to the side plates 46 and 47 of the belt conveyor 4(m).

The rotatable plate 85 is able to rotate in the forward direction (clockwise as viewed from the right in FIG. 17) with its weight from a state of being suspended with the latitudinal shaft 84. However, rotatable plate 85 cannot be rotated in the opposite direction, since an edge of an upper end of the rotatable plate 85 hits a lower side of the connecting portion 81. It therefore cannot be rotated in the direction of counterclockwise from a state of FIG. 17.

In the belt conveyor 4(m) mounted with the upper joint member 48 and the lower joint member 49 as mentioned above, the coins which have ejected from the upper joint member 48 of a belt conveyor 4(m−1), not shown, located at a left side of FIG. 11, are dropped onto the belt 59 via an opening of the connecting portion 81 of the lower joint member 49 of the above belt conveyor 4(m). When the belt 59 is driven in the direction of positive rotation from the left to the right in FIG. 11, the coins dropped onto the belt 59 are conveyed by the belt 59 just as they are, and are ejected via an opening of the connecting portion 76 of the upper joint member 48 positioned at the right end of the belt conveyor 4(m). On the other hand, when the belt conveyor 4(m) is used as the second belt conveyor and the belt 59 is driven in the opposite direction from the right to the left in FIG. 11, the coins dropped onto the belt 59 hit the rotatable plate 85 rotating the plate in the direction of clockwise, and are ejected via the left end of the belt conveyor 4(m). Then the coins are fed to the hopper portion 20 as mentioned above.

Referring to the above-mentioned embodiment, since the annular connecting portions 76 and 81 of the upper joint member 48 and the lower joint member 49 of each belt conveyor 4(m) are connected between adjacent belt conveyors, a bore/inner diameter of the connecting portion 76 of the upper joint member 48 is formed a little bigger than an outer diameter of the connecting portion 81 of the lower joint member 49, and the connecting portion 76 of the upper joint member 48 fits with an external circumference of the connecting portion 81 of the lower joint member 49. Also, even when the connecting portion 76 of the upper joint member 48 of one belt conveyor 4(m) fits with the connecting portion 81 of the lower joint member 49 of the other belt conveyor 4(m+1), both connecting portions are of annular shape, therefore, the belt conveyors 4(m) and 4(m+1) are rotatable in a range with the shaft portions 55 of the positioning members 43 of each of the belt conveyors in the center. In such a structure of the system, since a plurality of belt conveyors can be connected not only linearly but also in a curved relation to each other in the carousel 1 of various configuration, supply and collection of the coins are able to be executed automatically for all the gaming machines constructing one carousel.

In addition, in the above-mentioned embodiment, a group of (the first and second) belt conveyors is combined for the coin carrier installed at a position under each gaming machine, such that the second belt conveyor for the coin carrier of one gaming machine is arranged to be the first belt conveyor toward the following coin carrier. However, if an interval between one gaming machine and the following gaming machine is long or bending, the structure may contain one or more belt conveyors which is not combined with the coin carrier at an interval of those gaming machines.

Further, the apparatus for feeding the coins from each belt conveyor into the upper gaming machine is not limited to be of the escalator type. Instead, a coin carrier using belt conveyor or other mechanism that can feed the coins upward may be employed.

In addition, such structure may be provided with a cash box instead of the coin washer 9 of FIG. 5, wherein the belt conveyors are arranged to be substantially annular, and the coins are collected in the cash box from the belt conveyors by a distributor, as required.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A coin supply and collection apparatus for a plurality of gaming machines comprising:

conveyor means for conveying coins used in each of the plurality of gaming machines, said conveyor means being disposed beneath the plurality of gaming machines; and a plurality of coin feeders for feeding the coins fed from said conveyor means into respectively associated ones of the plurality of gaming machines, wherein said conveyor means, with respect to one of said coin feeders, associated with one of said gaming machines, is provided with a first conveyor for receiving and conveying the coins from a coin delivery side to said one of said gaming machines, and a second conveyor arranged to receive coins from said first conveyor and to convey the received coins toward said one of said coin feeders, said second conveyor functioning as the first conveyor for conveying the received coins toward a subsequent gaming machine.

2. The coin supply and collection apparatus according to claim 1, wherein each of said gaming machines is installed on a respective gaming machine base, said first and second conveyors each being provided with a respective belt conveyor disposed within said gaming machine base, and each of said coin feeders is provided with a coin carrier having an escalator disposed within said gaming machine base.

3. The coin supply and collection apparatus according to claim 1, wherein there is further provided:

a positioning member rotatably arranged below said first and second conveyors; and support means for engaging with said positioning member and supporting said first and second conveyors, wherein a direction of coin conveyance of said first and second conveyors can be adjusted.

4. The coin supply and collection apparatus according to claim 2, wherein there is further provided a positioning member disposed below the belt conveyors, said positioning member being rotatable in synchrony with said belt conveyors, said support means being arranged to engage with said positioning member and to support said belt conveyors to be movable, whereby a direction of coin conveyance can be adjusted.

5. The coin supply and collection apparatus according to claim 2, wherein the belt conveyors are connected to one another linearly or with a predetermined angle along the direction of coin conveyance.

6. The coin supply and collection apparatus according to claim 3, wherein said first and second conveyors are connected to one another linearly or with a predetermined angle along a direction of coin conveyance.

7. The coin supply and collection apparatus according to claim 4, wherein said belt conveyors are connected to one another linearly or with a predetermined angle along a direction of coin conveyance.

8. The coin supply and collection apparatus according to claim 1, wherein said first and second conveyors are provided with connecting means for connecting with each other, said first and second conveyors being arranged to be rotatable along with said connecting means.

9. The coin supply and collection apparatus according to claim 8, wherein said connecting means is further provided with:

an upper joint member provided at a lower side of an end of said first conveyor and having an inlet to an inside of said upper joint member and an outlet from said inside via which coins pass through; and a lower joint member provided at an upper side of an end of said second conveyor and arranged to fit with said upper joint member and having an inlet to an inside of said lower joint member and an outlet from the inside such that the coins pass through said upper and lower joint members being rotatable, along with a fitting portion, over a predetermined range.

10. The coin supply and collection apparatus of claim 1 wherein there are further provided:

a plurality of storage means each disposed correspondingly to the associated one of the plurality of gaming machines for storing the coins for use by the gaming machines; and determining means for determining whether coins are to be supplied to the storage means in response to the number of coins in a respectively associated one of the storage means.

11. The coin supply and collection apparatus of claim 10 wherein there is further provided means for changing a direction of operation of the second conveyor in response to said determining means.

* * * * *